US007672602B2

(12) United States Patent
Ariizumi et al.

(10) Patent No.: US 7,672,602 B2
(45) Date of Patent: Mar. 2, 2010

(54) DEVELOPING UNIT AND IMAGE FORMING APPARATUS WHICH FORCES CONSUMPTION OF TONER

(75) Inventors: Osamu Ariizumi, Kanagawa (JP); Kazumi Kobayashi, Tokyo (JP); Shinji Kobayashi, Kanagawa (JP); Fukutoshi Uchida, Kanagawa (JP); Takashi Enami, Kanagawa (JP); Ryohta Morimoto, Kanagawa (JP); Shin Hasegawa, Kanagawa (JP); Shinji Kato, Kanagawa (JP); Hitoshi Ishibashi, Kanagawa (JP); Kohta Fujimori, Kanagawa (JP); Nobutaka Takeuchi, Kanagawa (JP); Naoto Watanabe, Kanagawa (JP); Kayoko Tanaka, Tokyo (JP); Yushi Hirayama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 348 days.

(21) Appl. No.: 11/508,823

(22) Filed: Aug. 24, 2006

(65) Prior Publication Data

US 2007/0104499 A1 May 10, 2007

(30) Foreign Application Priority Data

Nov. 10, 2005 (JP) ..... 2005-325723

(51) Int. Cl.
*G03G 15/08* (2006.01)

(52) U.S. Cl. ..... 399/27

(58) Field of Classification Search ..... 399/27, 399/29

See application file for complete search history.

(56) References Cited

U.S. PATENT DOCUMENTS

| | | | | |
|---|---|---|---|---|
| 5,387,965 | A | 2/1995 | Hasegawa et al. | |
| 6,594,453 | B2 | 7/2003 | Kato | |
| 6,792,218 | B2 * | 9/2004 | Tungate et al. | 399/29 |
| 2004/0156645 | A1 * | 8/2004 | Nakazato | 399/27 |
| 2005/0025506 | A1 * | 2/2005 | Adachi | 399/27 |
| 2006/0029405 | A1 * | 2/2006 | Tanaka et al. | 399/27 |

FOREIGN PATENT DOCUMENTS

| | | | |
|---|---|---|---|
| JP | 04068370 A | * | 3/1992 |
| JP | 9-34243 | | 2/1997 |

(Continued)

OTHER PUBLICATIONS

Computer Translation of JP2005-092156A.*
U.S. Appl. No. 11/932,198, filed Oct. 31, 2007, Takeuchi, et al.
U.S. Appl. No. 11/856,304, filed Sep. 17, 2007, Oshige, et al.

(Continued)

*Primary Examiner*—Quana M Grainger
(74) *Attorney, Agent, or Firm*—Oblon, Spivak, McClelland, Maier & Neustadt, L.L.P.

(57) ABSTRACT

A developing unit supplies toner from a developing roller to an electrostatic latent image formed on an image carrier, and creates a visual image. A forced consumption unit causes, when a proportion of number of pixels used for forming the electrostatic latent image for a maximum image effective-width is equal to or less than a predetermined value, a forced consumption of toner by an amount corresponding to a difference between a toner amount corresponding to the number of pixels and a predetermined toner consumption amount. The forced consumption unit adds toner of an amount used in the forced consumption to an amount of toner to be supplied in a next imaging process.

10 Claims, 6 Drawing Sheets

FOREIGN PATENT DOCUMENTS

| | | | |
|---|---|---|---|
| JP | 3029648 | | 2/2000 |
| JP | 2003-270878 | | 9/2003 |
| JP | 2003255771 A | * | 9/2003 |
| JP | 2005-92156 | | 4/2005 |
| JP | 2005092156 A | * | 4/2005 |

OTHER PUBLICATIONS

U.S. Appl. No. 12/093,753, filed May 15, 2008, Oshige et al.
U.S. Appl. No. 12/094,198, filed May 19, 2008, Kato et al.
U.S. Appl. No. 12/112,525, filed Apr. 30, 2008, Koizumi, et al.
U.S. Appl. No. 07/811,056, filed Dec. 20, 1991, Yuko Harasawa, et al.

* cited by examiner

| IMAGE AREA RATIO (%) FOR SHEET SIZE (A4Y) | THRESHOLD FOR FORCED CONSUMPTION (%) | ENTER FORCED CONSUMPTION MODE? |
|---|---|---|
| 10 | 5 | NO |
| 6 | 5 | NO |
| 4 | 5 | YES |
| 2 | 5 | YES |
| 0.5 | 5 | YES |

FIG. 4C

| IMAGE AREA RATIO (%) FOR SHEET SIZE (A6T) | THRESHOLD FOR FORCED CONSUMPTION (%) | ENTER FORCED CONSUMPTION MODE? |
|---|---|---|
| 10 | 5 | NO |
| 6 | 5 | NO |
| 4 | 5 | YES |
| 2 | 5 | YES |
| 0.5 | 5 | YES |

FIG. 4D

| IMAGE AREA RATIO (%) FOR SHEET SIZE (A6T) | IMAGE AREA RATIO (%) CALCULATED BY MAXIMUM IMAGE EFFECTIVE-WIDTH | THRESHOLD FOR FORCED CONSUMPTION (%) | ENTER FORCED CONSUMPTION MODE? |
|---|---|---|---|
| 10 | 3.5 | 5 | YES |
| 6 | 2.1 | 5 | YES |
| 4 | 1.4 | 5 | YES |
| 2 | 0.7 | 5 | YES |
| 0.5 | 0.2 | 5 | YES |

DEVELOPING UNIT AND IMAGE FORMING APPARATUS WHICH FORCES CONSUMPTION OF TONER

CROSS-REFERENCE TO RELATED APPLICATIONS

The present document incorporates by reference the entire contents of Japanese priority document, 2005-325723 filed in Japan on Nov. 10, 2005.

BACKGROUND OF THE INVENTION

1. Field of the Invention

The present invention relates to a developing unit and an image forming apparatus, and more particularly, to a developer collecting mechanism.

2. Description of the Related Art

In an image forming apparatus, such as a copier, a printer, a facsimile apparatus, or a printing machine, a copy of an image is obtained by transferring a visible image formed on a photo-sensitive element as a latent image onto a recording medium, such as a printing paper, by a transfer unit provided near a process cartridge that includes a charging unit, a developing unit, and a cleaning unit.

In a visible-image processing step, two-component developer including toner and carrier and one-component developer not including carrier are used and two types of methods are used for applying the toner to the electrostatic latent image. One method is the contact type method by which these developers allow an electrostatic latent image on an image carrier to use the electrostatic force to attract toner. The other method is the non-contact type method by which toner is allowed to fly by an electric field action provided by a developing bias and the toner is attracted by an electrostatic latent image (see, for example, Japanese Patent Application Laid-Open No. 2003-270878).

When a charge amount of toner is balanced, in a developing process, with an electrostatic amount of an electrostatic latent image due to an electrostatic relation between the toner and the electrostatic latent image, no more toner is attracted by the electrostatic latent image and thus toner is not consumed any more (i.e., not used) and is recovered in a developing unit.

The toner recovered in the developing unit may cause a problem as described below. Specifically, toner is charged when the toner is stirred and mixed in a developing unit before being supplied to an electrostatic latent image or when friction is caused between a surface of a developing roller provided to be opposed to an image carrier in a developing unit and a blade provided near this surface. In a developing method using one component-system developer in particular, a toner layer may be allowed to be a uniform thin film by a surface of a developing roller composed of a metal roller for example to subsequently fly the toner toward an electrostatic latent image. In this case, the characteristic (charging characteristic in particular) of the toner may deteriorate due to friction caused in toner at the surface of the blade to cause a toner layer having a reduced thickness or of a developing roller or due to the stirring and mixing of the toner in transportation and stirring processes.

The deteriorated toner characteristic (deteriorated charging characteristic in particular) is caused when an external additive included in developer, which is an additive used to adjust the fluidity or an amount of friction charge and to improve a cleaning property, is buried in toner due to the temporal friction or stirring. An external additive may be the one that is composed of fine powders of colloidal silica ($SiO_2$), titanium oxide, aluminum, or fatty acid metal to be added to the surface of toner.

When a developing concentration declines, toner may be supplied to provide an appropriate developing concentration. When new toner is introduced into a developing unit and is mixed with not-yet-consumed toner left in the developing unit (hereinafter, "residual toner"), friction may be caused between the former and the latter to charge the residual toner to have a reverse polarity. Then, the former toner may be bound with the latter toner and the bound toners may be attracted by a background potential of an image carrier, causing a dirty background. When the non-contact type developing method is used on the other hand, temporal friction or stirring of toner may increase a charge amount of the residual toner, which may suppress the flying performance when the toner flies while being attracted by the surface of a developing roller. This may cause a risk where an appropriate image concentration cannot be obtained.

A conventional method to prevent a declined image concentration due to deteriorated toner is disclosed in, for example, Japanese Patent No. 3029648. According to this method, a printing rate of every one image formation is calculated and, when the printing rate is smaller than a predetermined printing rate (i.e., when a toner consumption amount is small and an amount of residual toner is large), an image of a checkered pattern providing a toner consumption amount depending on the printing rate is formed before the next image formation is performed. Then, a transfer process is skipped and toner is recovered by a cleaning unit, thereby performing a forced consumption of toner.

Another example of a system for the forced consumption of toner is disclosed in, for example, Japanese Patent Application Laid-Open No. H9-34243. According to this system, an image forming proportion or the number of an output after the final consumption and supply of a predetermined amount of toner is determined to start a forced consumption mode when the image forming proportion is equal to or lower than a predetermined proportion.

However, this method has a problem as described below. In the control of toner supply based on the forced consumption of toner, toner is supplied only in an amount of forcedly-consumed toner. Thus, this control of toner supply does not consider the supply of toner in an amount of toner consumed for a formed image or supplies toner in an amount of toner consumed in a no-image part in parallel with the consumption.

When the method that does not consider the supply of toner in an amount consumed in an image-formed part is used, although the deterioration of developer can be prevented to some extent, the supply of toner is insufficient to cause an output image having a reduced density, causing an unstable control of an image concentration. Furthermore, the supply of toner in an amount of consumed toner in parallel with the consumption may not supply, when a no-image part has a small area, a sufficient amount of toner. This also causes, as in the above case, a problem of an unstable concentration of an output image.

A conventional toner supply includes a calculation of an amount of forcedly-consumed toner. In this calculation, whenever a paper is transferred, an amount of actually-consumed toner is compared with a predetermined toner consumption amount to supply toner. However, when an image having a very small image area ratio is suddenly outputted, an actual amount of toner for the image part is also small and thus a large amount of toner is not consumed and is used in a cleaning process. Thus, an increased load is applied to the cleaning process and thus a cleaning unit may not recover a part of the not-consumed toner, which may cause an abnormal image in which the not-recovered toner appears in the next image.

Recently, more image forming apparatuses use developer having a smaller particle diameter for the purpose of providing a high image quality. Although an improvement of a granular level by increasing an inclusion rate of fine powders having a small particle diameter is a very important factor to provide a high image quality, a combination of toner having a small particle diameter with carrier having a small particle diameter increases the bulk density of the toner attached to the carrier. Thus, a toner support amount and a charge amount of the carrier are increased and toner aggregation due to the small particle diameter is increased, thus deteriorating the fluidity.

As a result, the carrier and the toner having a contact to each other are difficult to separate from each other and thus deterioration of developer due to carrier spent is easily caused. In other words, developer having a particle diameter makes it difficult to control the supply of the developer in an appropriate manner.

SUMMARY OF THE INVENTION

It is an object of the present invention to at least partially solve the problems in the conventional technology.

A developing unit according to one aspect of the present invention supplies toner from a developing roller to an electrostatic latent image formed on an image carrier, and creates a visual image. The developing unit includes a forced consumption unit that causes, when a proportion of number of pixels used for forming the electrostatic latent image for a maximum image effective-width is equal to or less than a predetermined value, a forced consumption of toner by an amount corresponding to a difference between a toner amount corresponding to the number of pixels and a predetermined toner consumption amount. The forced consumption unit adds toner of an amount used in the forced consumption to an amount of toner to be supplied in a next imaging process.

An image forming apparatus according to another aspect of the present invention includes a developing unit that supplies toner from a developing roller to an electrostatic latent image formed on an image carrier, and creates a visual image. The developing unit includes a forced consumption unit that causes, when a proportion of number of pixels used for forming the electrostatic latent image for a maximum image effective-width is equal to or less than a predetermined value, a forced consumption of toner by an amount corresponding to a difference between a toner amount corresponding to the number of pixels and a predetermined toner consumption amount. The forced consumption unit adds toner of an amount used in the forced consumption to an amount of toner to be supplied in a next imaging process.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 4A to 4D are a diagram and tables for explaining difference between determination of forced consumption mode by calculation of image area ratio implemented by control unit and forced consumption by calculation by conventional structure.

DETAILED DESCRIPTION OF THE PREFERRED EMBODIMENTS

Exemplary embodiments of the present invention will be explained in detail below with reference to the accompanying drawings.

Figure 1:
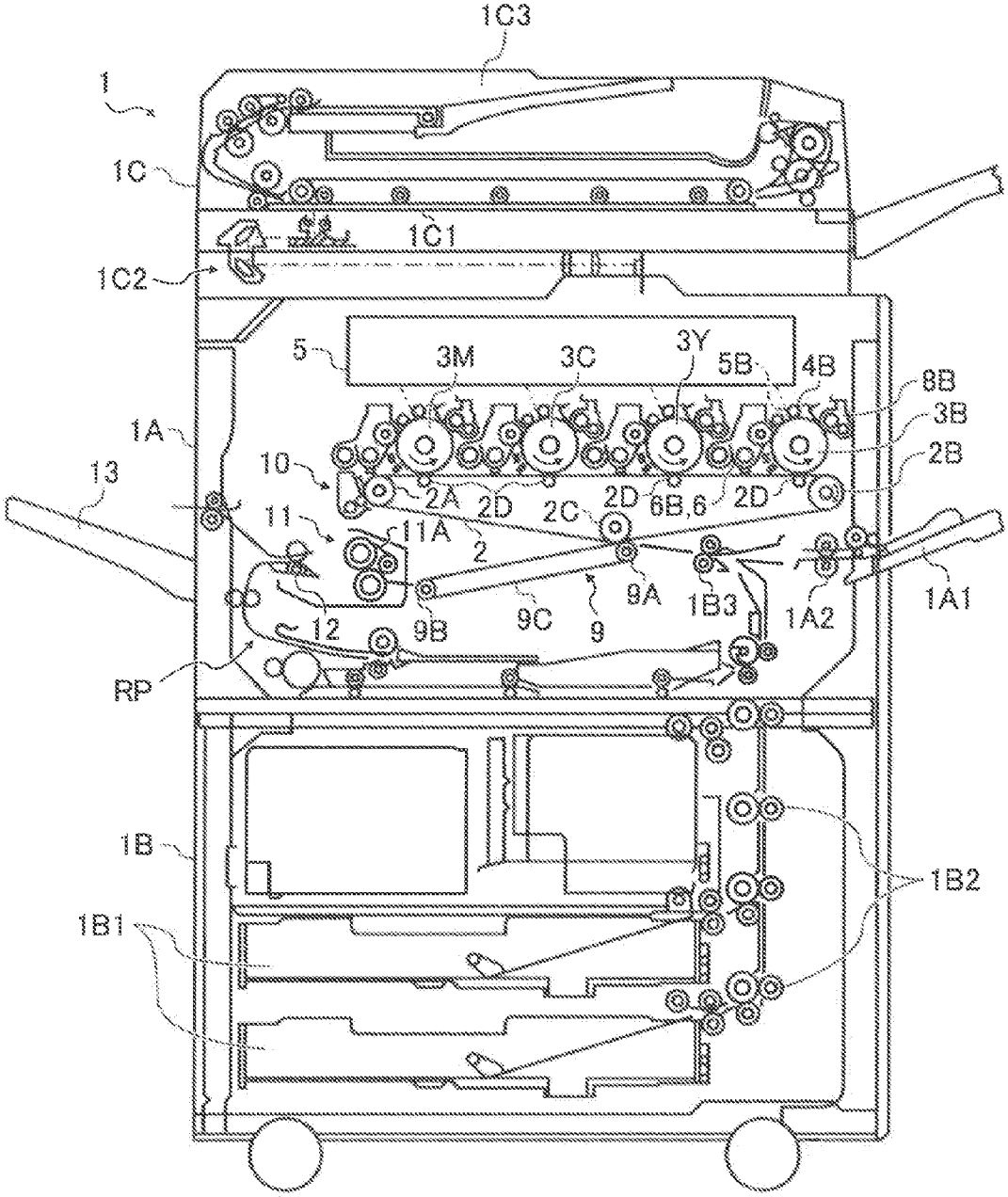
FIG. 1 is a schematic diagram for explaining the structure of an image forming apparatus in which a developing unit according to the present invention is used.

FIG. 1 is a diagram of an image forming apparatus 1 in which a transfer unit according to example of the present invention and a process cartridge including the transfer unit therein are provided.

The image forming apparatus 1 is a tandem-type color printer in which a plurality of photo-sensitive elements are arranged. These photo-sensitive elements function as an image carrier that can form an image of colors that can be subjected to a color separation. In the image forming apparatus 1, toner images formed on the respective photo-sensitive elements are transferred, in a superposed manner, onto an intermediate transfer body and then the superposed images are simultaneously transferred onto a sheet such as a recording paper, thereby forming a polychromatic image. The present invention can be applied not only to a color printer but also to various image forming apparatuses such as a color copier, a facsimile apparatus, and a printing machine.

In FIG. 1, the image forming apparatus 1 is structured in a manner as described below. An image forming unit 1A is positioned at the center in a vertical direction. At the lower side of the image forming unit 1A, a paper feeding unit 1B is provided. At the upper side of the image forming unit 1A, a document scanning unit 1C including a document table 1C1 is provided.

The image forming unit 1A includes a transfer unit composed of an intermediate transfer belt 2 having an extending surface in a horizontal direction. At the upstream of the intermediate transfer belt 2, a configuration to form an image of complementary colors of color-separated colors is provided.

In the image forming unit 1A, photo-sensitive elements 3B, 3Y, 3C, and 3M that can support an image of toners of colors having a complementary color relation (yellow, magenta, cyan, and black) are arranged along an extending surface of the intermediate transfer body 2. Hereinafter, when all of the photo-sensitive elements have the same meaning in the following description, these photo-sensitive elements are collectively represented as photo-sensitive elements 3.

The respective photo-sensitive elements 3B, 3Y, 3C, and 3M are composed of drums that can be rotated in the same direction (counterclockwise direction in FIG. 1). The photo-sensitive elements 3B, 3Y, 3C, and 3M are surrounded by components to implement an image forming processing during the rotation of a charging unit 4, a writing unit 5, a developing unit 6, a first transfer unit 7 as a transfer bias applying unit, and a cleaning unit 8 (these components are only denoted with 4B, 5B, 6B, 7B, and 8B as attached to the photo-sensitive element 3B for convenience and explanation).

The intermediate transfer belt 2 functions as a first transfer unit that sequentially transfers visible images from an imaging unit including the respective photo-sensitive elements. The intermediate transfer belt 2 is wound around a plurality of rollers 2A to 2C so as to move in the same direction as that of the photo-sensitive elements while being opposed to the photo-sensitive elements. The roller 2C is different from the rollers 2A and 2B that constitute the extending surface. The roller 2C is opposed to a second transfer unit 9 such that the intermediate transfer belt 2 is sandwiched by the roller 2C and the second transfer unit 9. In FIG. 1, the intermediate transfer belt 2 includes a cleaning unit 10.

The second transfer unit 9 is wound around a charge drive roller 9A and a driven roller 9B and includes a transfer belt 9C. The transfer belt 9C can be moved, at a second transfer position at which the second transfer unit 9 is positioned, in the same direction as that of the intermediate transfer belt 2. By a process in which the transfer belt 9C is charged by the charge drive roller 9A to transport a recording sheet while the recording sheet being electrostatically absorbed, polychromatic images superposed on the intermediate transfer belt 2 can be collectively transferred to the recording sheet or a supported image of a single color can be transferred to the recording sheet, respectively.

The second transfer position is supplied with a recording sheet sent from the paper feeding unit 1B. The paper feeding unit 1B includes: a plurality of paper feeding cassettes 1B1; a plurality of transportation rollers 1B2 positioned at a transportation path of a recording sheet sent from the paper feeding cassette 1B1; and a resist roller 1B3 positioned in front of the second transfer position. In this example, the paper feeding unit 1B is structured not only to include a transportation path for a recording sheet sent from the paper feeding cassette 1B1 but also to feed a certain type of a recording sheet not stored in the paper feeding cassette 1B1 to the second transfer position. This structure includes a manual paper feed tray 1A1 and a feed reel 1A2. The manual paper feed tray 1A1 is provided by partially raising a wall surface of the image forming unit 1A such that the manual paper feed tray 1A1 can be raised or lowered.

The transportation path of a recording sheet fed from the manual paper feed tray 1A1 is merged with a middle position of a transportation path extending from the paper feeding cassette 1B1 to the resist roller 1B3. In this manner, a recording sheet fed from any of the transportation paths can be associated with a resist timing by the resist roller 1B3.

The writing unit 5 (which is represented as a writing unit 5B in FIG. 1 for convenience) forms electrostatic latent images on the photo-sensitive elements 3B, 3Y, 3C, and 3M based on image information obtained by scanning a document on the document table 1C1 provided in the document scanning unit 1C or image information outputted from a computer (not shown) by controlling write light based on the image information.

The document scanning unit 1C includes a scanner 1C2 that exposes and scans a document on the document table 1C1. The document table 1C1 also has, at the upper face thereof, an automatic document feeding unit 1C3. The automatic document feeding unit 1C3 can invert a document fed to the document table 1C1 so that the respective top and back surfaces of the document can be scanned.

An electrostatic latent image on the photo-sensitive element 3 (which are represented as the photo-sensitive elements 3B, 3Y, 3C, and 3M in FIG. 1) formed by the writing unit 5 is developed to a visible image by the developing unit 6 (which is represented as a developing unit 6B in FIG. 1 for convenience) and the visible image is firstly transferred to the intermediate transfer belt 2. When toner images of the respective colors are transferred, in a superposed manner, to the intermediate transfer belt 2, then the toner images are collectively secondly transferred to a recording sheet by the second transfer unit 9.

In the secondly-transferred recording sheet, a not-yet-fixed image supported at the surface is fixed by a fixing unit 11. Although the details are not shown in FIG. 1, the fixing unit 11 has a belt fixing structure that includes a fixing belt heated by a heating roller and a pressure roller that is opposed to and that is abutted with the fixing belt. The presence of the region in which the fixing belt is abutted with the pressure roller (i.e., nip region) can increase a heating region for a recording sheet when compared with another roller fixing structure.

A direction along which a recording sheet having passed the fixing unit 11 is transported is changed by a path changing unit 12 provided at the rear side of the fixing unit 11 between a transportation path reaching a paper ejection tray 13 and a reverse transportation path RP.

In the image forming apparatus 1 having the structure as described above, an electrostatic latent image is formed on the uniformly-charged photo-sensitive element 3 by exposing and scanning a document provided on the document table 1C1 or based on image information from a computer. Then, the electrostatic latent image is developed to a visible image by the developing unit 6 and then a toner image is firstly transferred to the intermediate transfer belt 2.

When the toner image transferred to the intermediate transfer belt 2 is an image of a single color, the toner image is directly transferred onto a recording sheet fed from the paper feeding unit 1B. When the toner image transferred to the intermediate transfer belt 2 is a polychromatic image, then the first transfer is repeated for each of the images so that the images are superposed and the superposed images are collectively secondly transferred to a recording sheet. A not-yet-fixed image on the recording sheet subjected to the second transfer is fixed by the fixing unit 11. Thereafter, the recording sheet is fed to the paper ejection tray 13 or is inverted and is fed again to the resist roller 1B3.

Although the details are not shown in FIG. 1, the intermediate transfer belt 2 includes a base layer and an elastic body layer. The base layer consists of a base portion composed of fluorine resin having a small elongation or rubber material having a large elongation and material difficult to elongate (e.g., canvas). The elastic body layer uses fluorine rubber provided at the upper surface of this base layer and copolymer rubber of acrylonitrile and butadiene for example. The surface of the elastic body layer is provided with a coat layer that is coated with a fluorine resin to have an improved smooth surface.

The intermediate transfer belt 2 is wound around the rollers 2A and 2B which are at least one pair of rollers and the roller 2C having a backup function and is driven by the rotation of the roller 2A in the counterclockwise direction.

A surface extending between the rollers 2A and 2B (i.e., a flat surface having no curvature) is opposed to the photo-sensitive elements 3B, 3Y, 3C, and 3M of the respective imaging units. Transfer rollers 2D that electrostatically transfer a visible image on a photo-sensitive element are respectively provided such that the transfer rollers 2D and the respective photo-sensitive elements sandwich the intermediate transfer belt 2 and the transfer rollers 2D are opposed to the respective photo-sensitive elements.

In this example, a dummy image is formed by a forced supply of developer, i.e., an image is formed for a cleaning purpose without transferring the image to forcedly consume developer to exchange old developer with new developer, thereby preventing an increased charge amount of residual toner, uneven distribution of particle diameters, or deteriorated fluidity. This example also focuses on a point as described below. Although toner in the processing is supplied in an amount consumed in a dummy image, an amount of residual toner will be increased when the formation of images having a low concentration is continued before a forced consumption is performed. Thus, in this example, a supply amount of toner is controlled by considering an amount of toner consumed for an image having a low concentration. Hereinafter, a system for this control will be described.

Figure 2:
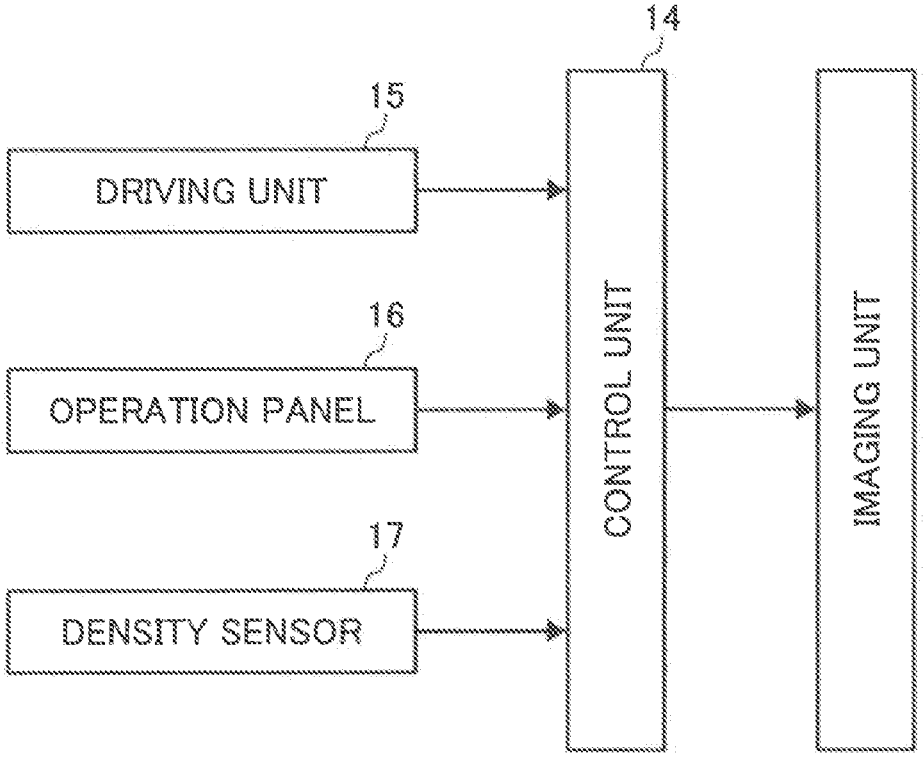
FIG. 2 is a block diagram for explaining the structure of a control unit used in the image forming apparatus shown in FIG. 1.

FIG. 2 is a block diagram of a control unit 14 that constitutes the main part of a forced consumption unit used for the forced consumption of toner (the control unit 14 will be described as a forced consumption unit).

In FIG. 2, the control unit 14 is mainly composed of a microcomputer in which a member related to this example is provided at an input side via an I/O interface (not shown). The member at the input side in this example is a driving unit 15 for a write unit working as a unit that detects a pixel amount as write data and an operation panel 16 to which the size of a recording sheet to be sent can be inputted. An output side is connected with an image forming processing unit of an imaging unit (i.e., the respective apparatuses that perform processes from a charging process to a transfer process) (shown as an imaging apparatus in FIG. 2 for convenience).

When a forced consumption is performed in this example, an image forming process other than a transfer process is performed and, as described below, toner of an image for a forced consumption formed on a photo-sensitive element is recovered in a cleaning process.

The control unit 14 functions as a forced consumption unit that has registered information for a pixel amount corresponding to an image formed on a photo-sensitive element drum. When the pixel amount does not reach a specified amount (i.e., when the pixel amount is equal to or lower than the specified pixel amount), then the control unit 14 causes a forced consumption of toner in an amount that equals to a difference in a toner amount between the specified pixel amount and a pixel amount corresponding to an image at the time.

Figure 3:
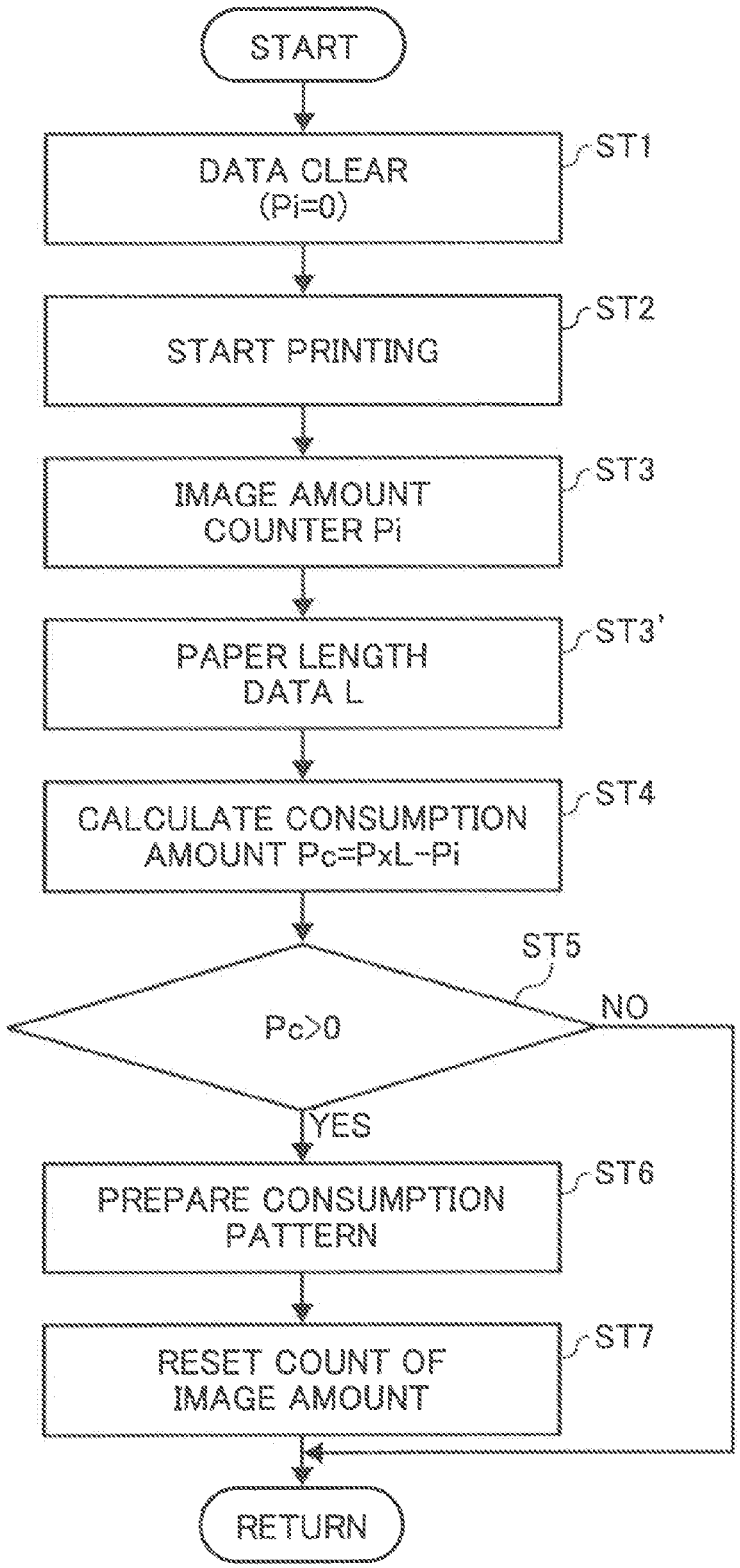
FIG. 3 is a flowchart for explaining a forced consumption processing implemented by the control unit.

FIG. 3 is a flowchart for explaining processings by the control unit 14 in the forced consumption mode. When the image forming apparatus 1 is started, stored data for example is initialized (ST1). When an operation panel (not shown) implements a print command (ST2), an image amount of a color image (Pi) is inputted from the driving unit 15 of a writing unit and is stored in a pixel amount counter B (ST3).

The image amount (Pi) stored at Step ST3 is a pixel amount Pi when the image is printed on a paper having a paper length L (which is assumed as the one inputted in Step ST3 for convenience).

When the pixel amount (Pi) and the paper length (L) are inputted, the control unit 14 calculates a toner consumption amount (Pc) of the image to be formed on an assumption that a pixel amount required for a unit paper length is represented as "P" based on the pixel amount (Pi) (ST4). When there is a difference between the toner consumption amount (Pc) of the image and the specified image amount (P) (ST5), then the formation of the image causing the difference is followed by the formation of a consumption pattern for a no-image region of the photo-sensitive element drum (ST6).

This consumption pattern is formed by the respective apparatuses other than the transfer unit 3. As a result, the difference between the toner consumption amount of the written-image and the specified consumption amount is forcedly consumed when the toner consumption amount of the written image is smaller than the specified consumption amount. Thus, deteriorated toner is prevented from occurring in a developing unit. After the forced consumption of toner, an image amount stored in the counter is reset in the counter B (ST7).

As described above, the forced consumption mode performed by the control unit 14 in this embodiment has been described. The forced consumption amount in this forced consumption mode is corrected to correspond to an actual toner consumption. This will be described hereinafter.

In this example, the forced toner consumption mode is selected based on an image area ratio obtained by a pixel amount corresponding to an image as described above. The image area ratio is calculated not only based on the pixel amount but also based on an effective width of the image. Specifically, the image area ratio is calculated based on the maximum image effective-width in the main scanning direction and the length of a recording sheet in the sub scanning direction. The image area ratio is calculated by $$\text{Image area ratio (maximum image effective-width)}\ (\%)=\{\text{image area (cm}^2)/(\text{length of transfer paper in sub scanning direction (cm)})\times\text{maximum image effective-width (cm)}\}\times 100 \quad (1)$$

Furthermore, when the image area ratio is used, an average value per "n" paper(s) is used. As a result, even when a sudden change is caused in the image area ratio (even when a change to an image having a low image area ratio is caused in particular), the use of the average value can prevent the sudden change in the image area ratio from being caused. This prevents an increased-cleaning load due to simultaneous forced consumptions in a large amount. The image area ratio is calculated by $$\text{Image area ratio (progressive average)}=\{\text{image area ratio (progressive average)}\times(n-1)+\text{image area ratio (the newest maximum image effective-width)}\}/n \quad (2)$$

The control unit 14 recognizes, with regards to the specified image area ratio (pixel amount), that a difference in toner amount from an image area ratio (pixel amount) obtained from an image formed at the present stage represents an amount of toner that does not contribute to the development. Thus, the control unit 14 subjects, to a forced consumption, the toner that does not contribute to the development and that remains in the developing unit. This prevents the residual toner from deteriorating due to the stirring or friction. Specifically, the control unit 14 determines whether a forced consumption is required or not based on Expressions (3) and (4).

$$\text{Image area ratio (progressive average)} \geqq \text{image area ratio (threshold value)} \quad (3)$$

$$\text{Image area ratio (progressive average)} \geqq \text{image area ratio (threshold value)} \quad (4)$$

In this example, the calculation method by Equation (1) for the forced consumption can be used to obtain an actual toner consumption rate as in a case where an actual size of a recording sheet that cannot be calculated only by an image area ratio because the size of the recording sheet is changed for example. This will be described hereinafter.

FIGS. 4A to 4D are a diagram for explaining a difference between a case where an image effective-width in a recording sheet is not used and a case where an image effective-width in a recording sheet is used.

Figures 4A, 4B:
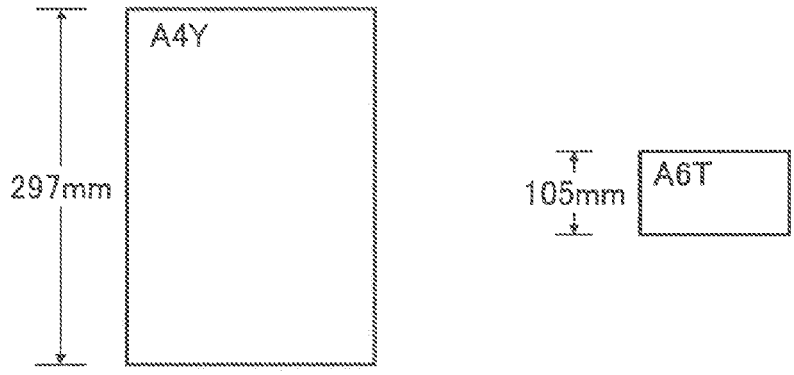

FIG. 4A shows a case where an A4-sized recording sheet for an A4 lateral transportation (A4Y) in which the recording sheet is transported along the longitudinal direction and a case where an A6-sized recording sheet for an A6 longitudinal transportation (A6T) in which the recording sheet is transported in a direction perpendicular to the longitudinal direction. FIGS. 4B and 4C show a result when these recording sheets are determined for the forced consumption mode based on the system disclosed in Japanese Patent Application Laid-Open No. H9-34243 in which the forced consumption mode is performed only with a threshold value of an image area ratio of 5%.

On the other hand, FIG. 4D shows a system in which the forced consumption mode is determined by adding the maximum image effective-width to the image area ratio based on Equation (1) in this example.

As can be seen from the results, when the result shown in FIG. 4C is compared with that shown in FIG. 4D for a case where the image area ratio is 10%, the former has a different determination result from that of the latter with the threshold value of 5% of the image area ratio as an established criterion for the forced consumption mode. Thus, the system disclosed in Japanese Patent Application Laid-Open No. H9-34243 fails to perform the forced consumption even when an actual toner consumption amount is small and thus an amount of residual toner (i.e., toner remaining in the developing unit) is large. This easily causes the residual toner to deteriorate due to the stirring or friction.

When it is determined that the forced consumption is required on the other hand, a consumption pattern suitable for the image area ratio is formed as a dummy image. This consumption pattern is calculated by Equation (5) by using a difference between the image area ratio and a specified amount (consumption amount corresponding to the threshold value).

(Image area of consumption pattern)={image area ratio (threshold value)−image area ratio (progressive average)}/100×(maximum image effective-width)×(length of recording sheet in sub scanning at output of image just before the subject image) (5)

Furthermore, the length of the recording sheet in the sub scanning direction at an output of an image just before the subject image in Equation (5) is calculated as Equation (6), by using the length of the consumption pattern in the main scanning as a fixed value and by changing the length in the sub scanning direction.

(Length of consumption pattern in sub scanning direction)=(image area of consumption pattern)/(length of consumption pattern in main scanning direction)×(pattern coefficient) (6)

Figure 5:
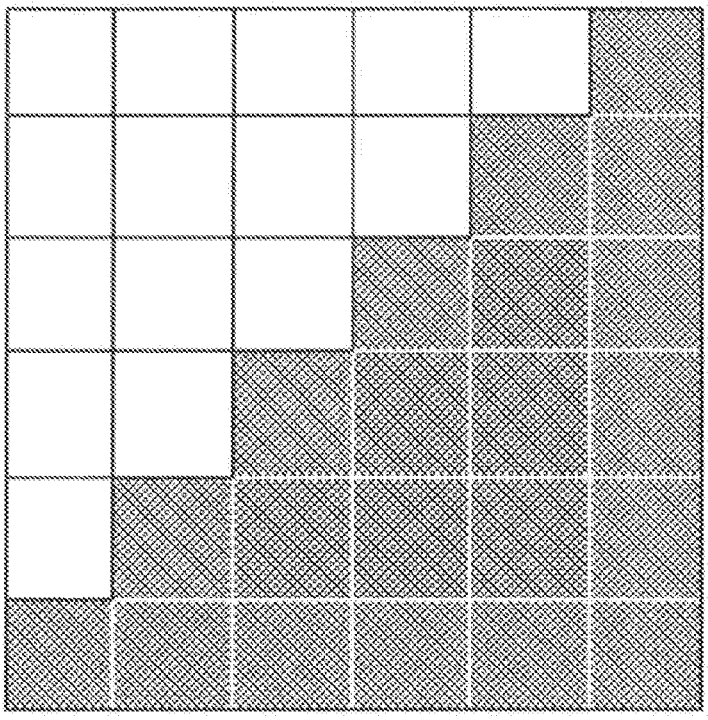
FIG. 5 is a diagram of a halftone dot-like pattern used as toner consumption pattern.

The pattern coefficient in Equation (6) is a coefficient by the halftone dot-like pattern as shown in FIG. 5. When the consumption pattern is always an output of an image entirely colored with black, the pattern coefficient is 1. When the consumption pattern is an output of an image in which white and black are continuously provided, then the consumption pattern has a length in the sub scanning direction correspondingly longer than the one and the pattern coefficient is calculated as Pattern coefficient=(entire area)/1(the number of black parts in the area)=2

In this example, a stepwise pattern shown in FIG. 2 was used as a shape of this consumption pattern. However, this pattern also may another pattern other than the entirely-colored one. In this case, the pattern coefficient is 36/21.

As shown in FIGS. 4B to 4D, in this example, the threshold value of the image area ratio is 5% and the length of the consumption pattern in the main scanning direction is 25 cm. However, these values also may be arbitrarily set in each image forming apparatus. In the control unit 14, a processing is performed to add, as an amount of toner to be supplied in the next imaging, the consumption amount in the consumption pattern calculated by the respective Equations.

In a supply and control method used in this example, two supply and control methods are used. One method is a pixel supply control in which a toner supply amount is calculated based on an input image. The other method is a sensor supply and control in which a toner concentration is detected by a sensor to calculate a toner supply amount based on the fluctuation of the toner concentration.

The total supply amount in this case (H(mg)) is the sum of the pixel supply/control amount (P_×1 (mg)) and the sensor supply/control amount (P_Vt (mg)) calculated by $$H=P_P\times 1+P_Vt \tag{7}$$

The pixel supply/control amount term (P_P×1) in Equation (7) is expressed as $$P_P\times 1=M\times P\times 1\times a1 \tag{8}$$

where "M" is a toner adhesion target value (mg/cm$^2$) per a unit area, "P×1" is an image area (cm$^2$) of an input image, and "a1" is a supply coefficient of 1.

In Equation (8), the image area term of the input image of the image part is added with the image area corresponding to the consumption pattern. This calculation is performed by $$P_P\times 1=M\times(P\times 1+Nimg)\times a1 \tag{9}$$

where "Nimg" is an image area (cm$^2$) of the consumption pattern calculated by Equation (5).

A control is performed in which an operation that adds, to the next supply, an operation that supplies toner in an amount corresponding to the consumption pattern obtained by the calculation method as described above. Thus, even when an image having a low concentration is outputted, i.e., when an image having a small image area is outputted, toner can be optimally supplied in the next imaging in consideration of the amount of toner consumed by a processing in which a visible image of the image having a low concentration is provided. At the same time, a defective cleaning due to simultaneous forced consumptions of a large amount of toner, which is an inconvenience caused by an image having a small image area ratio, can be avoided, thus stabilizing the concentration of the image.

As describe above, according to an embodiment of the present invention, the forcedly-supplied toner is added to an amount of toner to be supplied in the next imaging. This can prevent a shortage of components used for a visible image processing of an image part, thus stabilizing an image concentration even when an image having a small image area is outputted.

Furthermore, according to an embodiment of the present invention, an average value of image area ratios during a paper transfer is calculated and a consumption amount corresponding to the average value is calculated. This prevents a large amount of toner from being forcedly-consumed simultaneously. This can prevent a cleaning load caused by a cleaning of a large amount of consumed toner, thus preventing an abnormal image due to a defective cleaning.

Moreover, according to an embodiment of the present invention, a consumption pattern is provided as a halftone dot-like pattern. This can prevent toner from simultaneously collecting at a cleaning unit to prevent a cleaning load from increasing. This can prevent an abnormal image due to a defective cleaning, thus providing a stable image.

Furthermore, according to an embodiment of the present invention, not only an amount of toner supplied by the forced consumption of toner remaining on an image carrier but also an amount of toner consumed by an actual image part are considered. Thus, even when an image having a low concentration is formed, it is possible to estimate an increased amount of toner to be subjected to a forced consumption higher than that required for an image having a higher concentration than this low concentration image. Thus, an optimal amount of toner to be supplied in the next imaging can be set. This can prevent an abnormal image due to an increased cleaning load from being caused, thus maintaining a stable image concentration.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing unit that supplies toner from a developing roller to an electrostatic latent image formed on an image carrier, and creates a visual image, the developing unit comprising:

a forced consumption unit that causes a forced consumption of a quantity of forcedly consumed toner, the forced consumption occurring when a proportion of a number of pixels used for forming a maximum effective-width of a first electrostatic latent image formed on the image carrier is equal to, or less than, a threshold value, wherein the forced consumption unit determines a first quantity of forcedly consumed toner, the first quantity of forcedly consumed toner corresponding to a difference between a quantity of toner corresponding to a number of pixels of the first electrostatic latent image and a first predetermined quantity of toner, the forced consumption unit causes a correction in the first quantity of forcedly consumed toner based on an average image area ratio for a plurality of images, the corrected first quantity of forcedly consumed toner corresponding to a difference between a quantity of toner corresponding to an average number of pixels for the plurality of images and a second predetermined quantity of toner, and the forced consumption unit adds, to the developing roller, the corrected first quantity of forcedly consumed toner to a quantity of toner to be supplied in forming on the image carrier a next electrostatic latent image.

2. The developing unit according to claim 1, wherein the forced consumption unit causes the forced consumption of the toner by forming a latent image of a halftone dot-shaped pattern on a non-image portion on the image carrier and visualizing the latent image.

3. An image forming apparatus comprising:

a developing unit that supplies toner from a developing roller to an electrostatic latent image formed on an image carrier, and creates a visual image thereon, wherein the developing unit includes a forced consumption unit that causes a forced consumption of a quantity of forcedly consumed toner, the forced consumption occurring when a proportion of a number of pixels used for forming a maximum effective-width of a first electrostatic latent image formed on the image carrier is equal to, or less than, a threshold value, wherein the forced consumption unit determines a first quantity of forcedly consumed toner, the first quantity of forcedly consumed toner corresponding to a difference between a quantity of toner corresponding to a number of pixels of the first electrostatic latent image and a first predetermined quantity of toner, the forced consumption unit causes a correction in the first quantity of forcedly consumed toner based on an average image area ratio for a plurality of images, the corrected first quantity of forcedly consumed toner corresponding to a difference between a quantity of toner corresponding to an average number of pixels for the plurality of images and a second predetermined quantity of toner, and the forced consumption unit adds, to the developing roller, the corrected first quantity of forcedly consumed toner to a quantity of toner to be supplied in forming on the image carrier a next electrostatic latent image.

4. The developing unit according to claim 1, wherein the image area ratio is calculated by Image area ratio (maximum image effective-width)(%)={image area ($cm^2$)/((length of transfer paper in sub scanning direction (cm))×maximum image effective-width (cm))}×100.

5. The developing unit according to claim 4 wherein when the image area ratio is used, an average value per "n" paper(s) is used, and the image area ratio is calculated by "Image area ratio (progressive average)={image ratio (progressive average)×(n−1)+image area ratio (a newest maximum image effective-width)}/n."

6. The developing unit according to claim 5, wherein the forced consumption unit determines whether a forced consumption is required or not based on the expressions:

Image area ratio (progressive average)≧image area ratio (threshold value); and

Image area ratio (progressive average)<image area ratio (threshold value).

7. The image forming apparatus according to claim 2, wherein the image area ratio is calculated by Image area ratio (maximum image effective-width)(%)={image area ($cm^2$)/(length of transfer paper in sub scanning direction (cm))×(maximum image effective-width (cm))}×100."

8. The image forming apparatus according to claim 7, wherein when the image area ratio is used, an average value per "n" paper(s) is used, and the image area ratio is calculated by "Image area ratio (progressive average)={Image area ratio (progressive average)×(n−1)+image area ratio (a newest maximum image effective-width)}/n."

9. The image forming apparatus according to claim 8, wherein the forced consumption unit determines whether a forced consumption is required or not based on the expressions:

Image area ratio (progressive average)≧image area ratio (threshold value); and

Image area ratio (progressive average)<image area ratio (threshold value).

10. The image forming apparatus according to claim 3, wherein the forced consumption unit causes the forced consumption of the toner by forming a latent image of a halftone dot-shaped pattern on a non-image portion on the image carrier and visualizing the latent image.

* * * * *